US006483063B2

(12) United States Patent
Chu

(10) Patent No.: US 6,483,063 B2
(45) Date of Patent: Nov. 19, 2002

(54) ELECTRICAL SWITCH INCLUDING A METAL HEAT SINK

(75) Inventor: Raymond Wai Hang Chu, Chai Wan (HK)

(73) Assignee: Defond Manufacturing Limited, Chai Wan (HK)

( * ) Notice: Subject to any disclaimer, the term of this patent is extended or adjusted under 35 U.S.C. 154(b) by 6 days.

(21) Appl. No.: 09/805,194

(22) Filed: Mar. 14, 2001

(65) Prior Publication Data

US 2002/0130027 A1 Sep. 19, 2002

(51) Int. Cl.[7] ..... H01H 15/04
(52) U.S. Cl. ..... 200/547; 200/551
(58) Field of Search ..... 200/551, 578, 200/547

(56) References Cited

U.S. PATENT DOCUMENTS 4,179,644 A * 12/1979 Vassos ..... 200/522
4,196,343 A * 4/1980 Han ..... 200/332.2
4,205,434 A * 6/1980 Brozoski et al. ..... 200/522
4,649,245 A * 3/1987 Lessig et al. ..... 200/327

* cited by examiner

*Primary Examiner*—Renee Luebke
(74) *Attorney, Agent, or Firm*—Leydig, Voit & Mayer, Ltd.

(57) ABSTRACT

An electrical switch includes a body, three control terminals and a common terminal for external connection and a movable contact for establishing connection between the control terminals and the common terminal. The movable contact has one end acting as the common terminal and three opposite ends that pivot to connect to the control terminals, respectively. Each opposite end is pivotable between a first position in contact with the corresponding control terminal and a second position separated from the corresponding control terminal. A switching member is supported for pivoting the opposite ends of the movable contact to establish the connection. A single metal heat sink is located within the body for contact by the opposite ends of the movable contacts when the movable contacts are in the second positions.

11 Claims, 1 Drawing Sheet

ELECTRICAL SWITCH INCLUDING A METAL HEAT SINK

The present invention relates to an electrical switch for controlling the operation of an electrical appliance.

BACKGROUND OF THE INVENTION

The temperature of electrical switches rises during operation. Heat is generated by electrical current flowing, through the switch contacts and by the making and breaking switch contact. Overheating of electrical switches, within the limitation of size, has always been a problem.

The invention seeks to mitigate or at least alleviate the problem by providing an electrical switch that has an improved heat dissipation capability.

SUMMARY OF THE INVENTION

According to the invention, there is provided an electrical switch comprising a body, a plurality of control terminals and a common terminal supported by the body for external connection, and a movable contact provided within the body for establishing connection between the control terminals and the common terminal. The movable contact has one part connected to the common terminal and a plurality of other parts movable to connect to the control terminals respectively. Each of the other parts is movable between a first position in contact with the corresponding control terminal and a second position separated from the corresponding control terminal. A switching member is supported by the body for moving the other parts of the movable contact to establish the connection. A common metal heat sink is located within the body for contact by the other parts of the movable contact when the other parts are in the second positions.

It is preferred that the other parts of the movable contact are resiliently biased towards their first positions.

Preferably, the body has a pair of opposite ends at which the control terminals and the common terminal are located respectively, and the movable contact extends across the control terminals and the common terminal.

More preferably, the movable contact has opposite first and second ends, with the first end acting as the one part and the second end divided into prongs acting as the other part, respectively.

Further, more preferably, the prongs are resiliently pivotable about the first end of the movable contact.

For example, the switching member is supported by the body for sliding movement.

The heat sink may comprise a metal plate.

In a preferred embodiment, the body has a defined space for receiving the heat sink, and the heat sink has a size substantially the same as that of the space for its location.

Preferably, the body comprises first and second parts, the first part including an abutment facing the second part, and the heat sink is provided within the second part and held in position by the abutment.

More preferably, the abutment extends at a position between the control terminals for flashover protection.

The invention also provides a hairdryer incorporating the electrical switch, comprising an electric motor and an electrical heating element connected to the control terminals, respectively.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
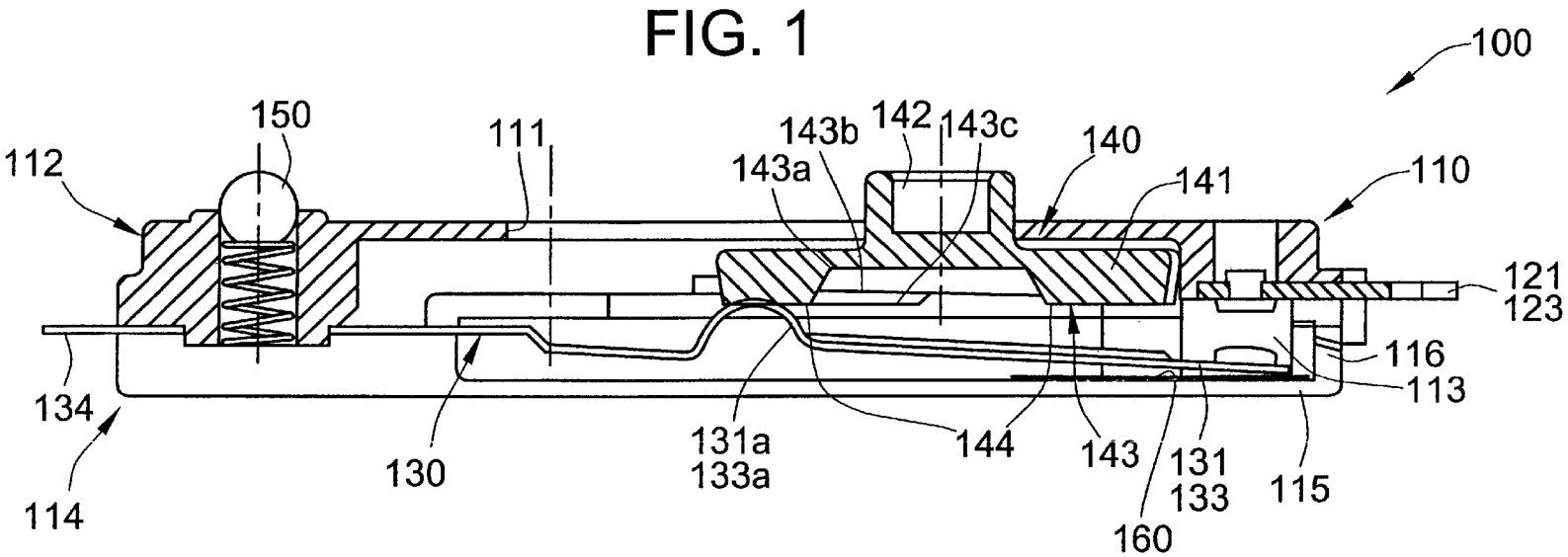
FIG. 1 is a cross-sectional side view of an embodiment of an electrical switch in accordance with the invention, the switch having three terminals connectable to a common terminal by means of respective parts of a movable contact and incorporating a heat sink for the parts of the movable contact.
Figure 2:
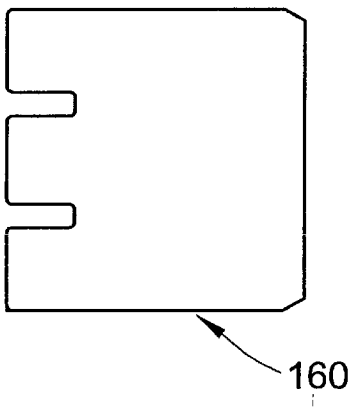
FIG. 2 is a plan view of the heat sink of FIG. 1.
Figure 3:
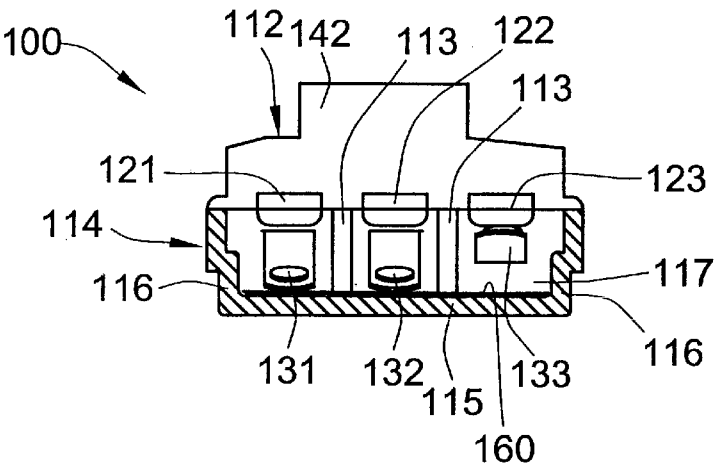
FIG. 3 is a cross-sectional end view of the switch of FIG. 1.

Referring to the drawings, there is shown an electrical switch, in the form of a slide switch 100, embodying the invention, which switch 100 has a rectangular body 110 including upper and lower parts 112 and 114 and comprises a series of three control terminals (fixed contacts) 121123 and a common terminal 134 supported at opposite ends of the body 110. The switch 100 includes a one-piece movable contact 130 provided within the body 110 for connecting the control terminals 121-123 to the common terminal 134. The movable contact 130 is manually movable by means of a switching member 140 that is supported by the body 110 for sliding movement.

The switch 100 is intended for use to control the operation of a hairdryer, for example, which has an electric motor for rotating a fan (to blow air) and two electrical heating elements (for heating the air). The hairdryer has an OFF mode, a MEDIUM mode in which the motor and only one of the heating elements are energised, a HOT mode in which the motor and both heating elements are used, and a COOL SHOT mode in which only the motor is energised.

The control terminals 121–123 are located at the right end of the upper body part 112 for external connection to the motor and the two heating elements respectively. The movable contact 130 extends from the left end to the right end of the switch body 110, and is resiliently pivotable to flex about its fixed left end which is integrally connected to and acts as the common terminal 134 for external connection to a mains power source.

The right end of the movable contact 130 is trifurcated into a series of three prongs 131–133 which are biassed, by virtue of inherent resilience, upwards into a first, normally-closed position in contact with the respective fixed contacts 121-123. The prongs 131–133 include, at about mid-length, respective inverted U-shaped bends 131A–133A.

The switching member 140 has a body formed by a horizontal base plate 141 and a knob 142. upstanding therefrom. The knob 142 extends upwards through a slot 111 of the upper switch body part 112, by means of which the overall switching member 14 0is slidable horizontally in opposite directions along-the slot 111.

The switch 100 includes a slidable cover (not shown) which covers the entire switch body 110 from above and is in engagement with the knob 142 for sliding the switching member 140. A spring-loaded ball 150 is provided on the upper body part 112 for successive engagement with a series of recesses formed on the underside of the cover to define four sequential switching positions for the switching member 140 corresponding to the OFF, MEDIUM, HOT and COOL SHOT modes of the hairdryer.

The base plate 141 of the switching member 140 provides, on its bottom surface, a predetermined switching profile 143 including three co-parallel linear cam tracks 143A–143C for pivoting the prongs 131–133 of the movable contact 130, respectively, by their bends 131A–133A. The individual surface profiles of the cam tracks 143A–143C differ from one another by including steps at different positions to form raised (or lowered as shown) protrusions 144 of different lengths.

At the OFF position of the switching member 140, the cam tracks 143A–143C press, with their protrusions 144 at one end, the corresponding bends 131A–133A and pivot all the three contact prongs 131–133 downwards to a second, open position away from the respective fixed contacts 121–123, whereby the motor and both heating elements are switched off. At the MEDIUM position of the switch member 140, no protrusions 144 are present on the cam tracks 143A–143B at that position for engaging the bends 131A–1311D. Accordingly, the first and second contact prongs 131–132 pivot upwards to the first positions in contact with the corresponding fixed contact 121–122, thereby switching on the motor and the relevant heating element. At the HOT position, the remaining heating element is also energised because no protrusion 144 is present on the cam track 143C at that position. At the COOL SHOT position, only the motor is energised, with both heating elements being switched off.

Accordingly, movement of the switching member 140 from one switching position to another will alter the switching profile 143 relative to the bends 131A–133A, thereby changing the positions of the contact prongs 131–133, switching and controlling the operation of the hairdryer.

The switch 100 includes a single heat sink 160, which is in the form of an E-shaped flat metal plate, for contact by the contact prongs 131–133 while they are in the second positions, unconnected from the fixed contacts 121–123. The heat sink 160 defines the second positions for the contact prongs 131–133, against which the prongs 131–133 bear, resiliently, under the action of the switching profile 143 as described above.

The lower body part 114 has a base wall 115 and three side walls 116 upstanding from the base wall 115 to define a space 117 at the right end of the body part 114, in which the heat sink 160 is received. The heat sink 160 has a size substantially the same as that of the space 117 for location, press fitting into position. The upper body part 112 has a pair of internal planar partitions 113, each of which extends at a position between two adjacent control terminals or fixed contacts 121/122 or 122/123 for protection against flashover that may otherwise occur therebetween. The partitions 113 face the lower body part 114 and are just sufficiently tall (downwards as shown) to abut and thus hold the heat sink 160 in the space 117.

Hairdryers belong to the type of electrical appliance that draw a relatively large electrical current, especially for the heating elements. Electrical switches for hairdryers must be able to deliver a larger current without overheating, but size has always been a constraining factor. In particular, hairdryers including heating elements are often switched on and off during operation. The breaking of contact between switch contacts inevitably causes extra heat by producing sparks, but provides a time slot during which the movable contacts are temporarily disconnected.

The subject switch 100 is useful to assist heat dissipation, while the prongs 131–133 of the movable contact 130 are disconnected, by providing a common heat sink 160 for the prongs 131–133 to share and conduct heat away. In order to maximize the heat dissipating capacity, the heat sink 160 or its outer surface can be made as large as possible by, for example, extending the metal plate to the left end of the switch lower body part 114, folding opposite sides of the metal plate upwards, and forming ribs on the upper surface of the metal plate.

The invention has been given by way of example only, and various other modifications of and/or alterations to the described embodiment may be made by persons skilled in the art without departing from the scope of the invention as specified in the appended claims.

What is claimed is:

1. An electrical switch comprising:

a body, a plurality of control terminals and a common terminal supported by the body for external connection, a movable contact provided within the body for establishing connection between the control terminals and the common terminal, the movable contact having one part connected to the common terminal and a plurality of movable parts for selective connection to respective control terminals, each of the movable parts being movable between a first position in contact with a corresponding control terminal and a second position separated from the corresponding control terminal, a switching member supported by the body for moving the movable parts to establish the contact, and a metal heat sink located within the body for common contact with the movable parts when the movable parts are in the second positions.

2. The electrical switch as claimed in claim 1, wherein the movable parts are resiliently biassed towards their first positions.

3. The electrical switch as claimed in claim 1, wherein the body has a pair of opposite ends at which the control terminals and the common terminal are located, respectively, and the movable contact extends between the control terminals and the terminal.

4. The electrical switch as claimed in claim 3, wherein the movable contact has opposite first and second ends, and the second end is divided into prongs as the movable parts, respectively.

5. The electrical switch as claimed in claim 4, wherein the prongs are resiliently pivotable about this end of the movable contact.

6. The electrical switch as claimed in claim 1, wherein the switching member is supported by the body for sliding movement.

7. The electrical switch as claimed in claim 1, wherein the heat sink comprises a metal plate.

8. The electrical switch as claimed in claim 1, wherein the body has a defined space for receiving the heat sink, and the heat sink has a size substantially the same as that of the defined space.

9. The electrical switch as claimed in claim 1, wherein the body comprises first and second parts, said first part including an abutment facing the second part, and the heat sink is provided within the second part and held in position by the abutment.

10. The electrical switch as claimed in claim 9, wherein the abutment extends between the control terminals for flashover protection.

11. A hairdryer incorporating the electrical switch as claimed in claim 1, comprising an electric motor and an electrical heating element connected to the control terminals, respectively.

* * * * *